United States Patent [19]

Dorel et al.

[11] Patent Number: 4,834,388

[45] **Date of Patent: * May 30, 1989**

[54] BOARD GAME

[76] Inventors: David Dorel; Margalit Lipkin, both of 361 Elm Dr., Apt. No. 13, Beverly Hills, Calif. 90212

[ * ] Notice: The portion of the term of this patent subsequent to Apr. 12, 2005 has been disclaimed.

[21] Appl. No.: 84,715

[22] Filed: Aug. 10, 1987

Related U.S. Application Data

[63] Continuation-in-part of Ser. No. 739,893, May 31, 1985, Pat. No. 4,736,953.

[51] Int. Cl.[4] ..... A63F 3/00

[52] U.S. Cl. ..... 273/236

[58] Field of Search ..... 273/236, 267, 276, 272, 273/309, 148 A

[56] References Cited

U.S. PATENT DOCUMENTS

| | | | |
|---|---|---|---|
| 3,850,434 | 11/1974 | Ockenfels | 273/236 |
| 4,227,698 | 10/1980 | Ishizuki | 273/303 |
| 4,390,183 | 6/1983 | Gedon | 273/148 A |

OTHER PUBLICATIONS

Gibson, Hoyle's Modern Encyclopedia of Card Games, 11-1980, pp. 291-295.

*Primary Examiner*—Richard C. Pinkham
*Assistant Examiner*—Benjamin Layno
*Attorney, Agent, or Firm*—W. Edward Johansen

[57] ABSTRACT

The present invention is a board game which includes eighty one playing pieces, a game board and six view blockers. The game board is marked with a plurality of main fields and a plurality of extra fields. Each playing piece is painted with one of nine different colors and carries one of nine different digits 1 to 9. Each player has a view blocker for blocking the other players' view of his collection of playing pieces. The main fields are in use when only two players are playing and are subdivided into identical spaces each sized to receive a playing piece. Three of the main fields have three spaces each. Six of the main fields have four spaces each. Four of the main fields have five spaces each. Four of the main fields have six spaces each. One of the main fields has seven spaces. One of the main fields has eight spaces. One of the main fields has nine spaces. One of the main fields is marked with an "X" and is called "penalty box". The extra fields are in use when more than two players are playing and are subdivided into identical spaces each sized to receive a playing piece. Two of the extra fields have three spaces each. One of the extra fields has four spaces. In the center of the main fields there is a container for storing the playing pieces.

1 Claim, 1 Drawing Sheet

Fig. 1.
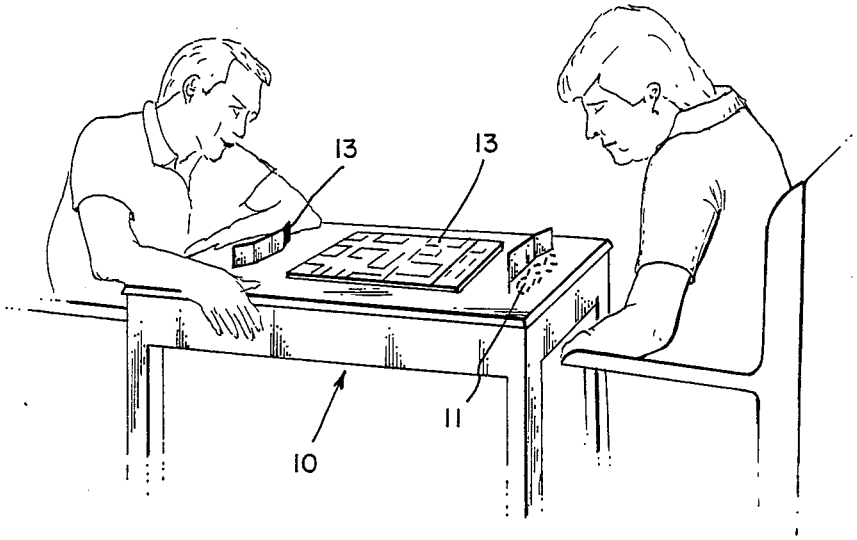
Fig. 3.
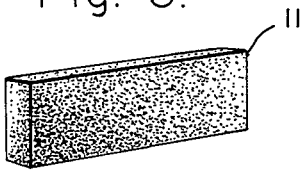
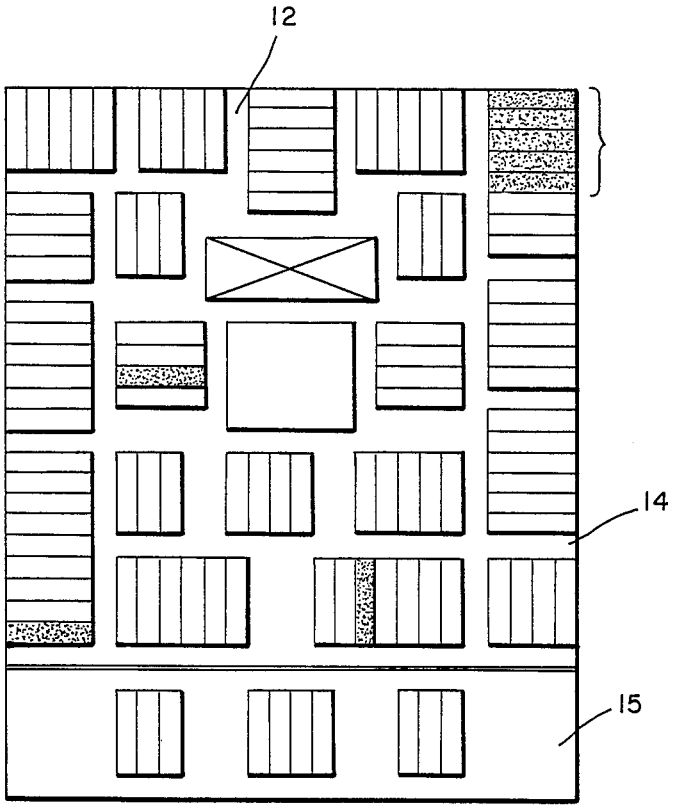
Fig. 2.

BOARD GAME

This application is a continuation-in-part of a parent application, filed May 31, 1985, having Ser. No. 39,893 and now U.S. Pat. No. 4,736,953.

BACKGROUND OF THE INVENTION

1. Field of the Invention

The present invention relates to a board game which has logical, educational and entertainment values and more particularly a board game which includes playing pieces and a game board with a plurality of placement locations where a player can play playing pieces already on the game board again.

2. DESCRIPTION OF THE ART

U.S. Pat. No. 4,227,698, entitled Table Game, issued to Saburo Ishizuki on Oct. 14, 1980, discusses a game for children is played using a plurality of like-shaped playing pieces or tiles divided into sets having an equal number of pieces per sets. Each piece of a set has a particular design in a particular color on one exposed surface of a piece are unmarked. The design and color utilized have been selected to be easily recognized by a young child and distinguishable from the other designs and colors used. A fixed number of pieces are selected randomly by players of the game to form a hand leaving a set number of remaining undivided pieces. Each selected price can be conveniently placed in a support rack carried by a four-sided frame of a playing board. Each player in rotation then selects a piece from the undivided remaining pieces. The player retains the selected piece if the design or color of the design matches that of a piece in the hand. If the design or color of the design does not match, the player discards that piece or another piece such that the number of pieces in the hand remains the same. The first player to obtain sets of matching pieces is a winner.

U.S. Pat. No. 3,850,434, entitled Outrageous Game, issued to Laurence R. Octenfels on Nov. 26, 1974, discusses a game, laced with luck, challenging the acquisition fervor, competitive spirit and trading shrewdness of the players is disclosed. A three-section game board is laid out to depict three types of sub-games associated with the first section allow them to acquire power cards and money and ranks the players. The sub-games associated with the second section allow the players to make various transactions to acquire power cards and/or money from other players or the bank. The sub-games associated with the third section allow the players to confront one another in all-out attacks for possession of power cards and money. Throughout the sub-games, the highest ranking player is advantaged as to selection of games, but the ranking player's advantage may be nullified by judicious usage of certain of the power cards. A factor of luck is introduced by a roll of a set of dice during some of the sub-games.

U.S. Pat. No. 4,390,183, entitled Small-Size Device For Simulating a Bridge Game, issued to Catherine Gedon on June 28, 1983, discusses a device for simulating a bridge deal and the tricks accomplished during a bridge game by means of movable clocks representing the hands and then the tricks comprises essentially a small game-board having cavities formed therein for receiving the movable blocks, each block having a visible face representing one of the 52 playing-cards; the cavities comprise a series of four grooves for inserting the blocks according to their specific suit, a series of four grooves for receiving the blocks corresponding to the cards of the four hands, and finally 13 rows of four cells each for receiving the blocks of the 13 tricks in four columns corresponding to the hands, from which the cards represented by the blocks are received.

U.S. Pat. No. 4,005,867, entitled Card Game, issued to Michael Joseph Yeager on Feb. 1, 1977, discusses a new game and a combination for playing the game, comprising a board and a pack of cards, the pack of cards including cards which carry a numeral thereon and are not marked to indicate a value, other cards having a "minus" point scoring value indicated thereon, other cards having a "plus" point scoring value indicated thereon, and still other cards having a numeral thereon, and also having a point scoring value indicated thereon, the board being divided into numbered spaces into which the cards may be played, there being one space for each different numeral on the cards of the pack.

U.S. Pat. No. 4,413,828, entitled Method of Playing a Board Game Utilizing Cards, issued to Anthony R. Gardner on Nov. 8, 1983, discusses a board game in which cards bearing numerical indicia are dealt onto a game board and arranged according to opposing sets of indicia on the playing board defining a plurality of placement locations for receiving the cards, the placement locations including a central leader location and a plurality of supporting locations surrounding the leader location. Two players control cards on opposing sides of the board. A novel game proceeds by conduction contests between the player's leader cards supported by cards in a particular supporting location. Losing cards involved in a contest are removed from the game and play proceeds to further contests.

U.S. Pat. No. 4,258,922, entitled Computer Math Game, issued to Alfred E. Landry on Mar. 31, 1981, discusses a game for both entertainment and education intended to increase familiarity and facility with binary mathematics and typical logic functions of the type normally carried out by digital computers. Two or more players each select by random chance a succession of binary digits. Instructions for operations to be performed on the digit sequence are likewise selected at random by the players, such operations being of the type typically performed in the arithmetic logic unit of a digital computer. In one embodiment of the invention, each digit in the sequence is temporarily recorded by each player on game board apparatus and is changed in accordance with the operations performed as the game progresses. A wide variety of game rules may be devised for carrying out adversary type games and determining a winner.

U.S. Pat. No. 3,977,681, entitled Game Using a Board And Playing Pieces, issued to Jerry D. Deitrich on Aug. 31, 1976, discusses a game for two players or teams using a 12 by 12 board and red, blue, and combination red and blue squares, the object of the game is to obtain the highest point score by having more of ones squares adjacent to squares of the same color than the opponent, 1 point being scored for each half edge continuous with the same color in the adjacent piece or playing base.

U.S. Pat. No. 3,677,549, entitled Board Game Apparatus, issued to Ivan Moscovitch on July 18, 1972, discusses a board game of educational value in familiarizing the player with the binary system, comprises a playing board and a set of identically-shaped playing pieces, each playing piece having "n" (e.g. 4) equal sides and being divided into "n" equal parts. The parts of the playing pieces are colored in two distinctive colors providing 2 possibilities of color-part combinations, each set including a playing piece for each of the 2 color part combinations. The playing board includes markings dividing the board into a plurality of at least 2 divisions, each division having an external shape identical to that of the playing pieces. Each playing piece represents a value in the binary-system of notation according to the position played on the board.

None of the prior art known to these applicants has been similar, nor does it closely resemble the present invention, where decision-making by the players must be announced before each move. It is, therefore, a primary object of the present invention to provide a board game where a decision made by a player who must announce his next move before he makes each move.

SUMMARY OF THE INVENTION

In view of the foregoing factors and conditions which are characteristic of the prior art it is the primary object of the present invention to provide a board game which has logical, educational and entertainment values and which includes playing pieces and a game board with a plurality of placement locations where a player can play playing pieces already on the game board again.

In accordance with the present invention an embodiment of a board game is described. The board game includes eighty one playing pieces, a game board and six view blockers. The game board is marked with a plurality of main fields and a plurality of extra fields. The playing pieces are bar-shaped, made of solid material and blank on one side. The other side, the face, is painted with one of nine different colors and carries one of nine different digits 1 to 9. Each player has a view blocker for blocking the other players' view of his collection of playing pieces. The main fields are in use when only two players are playing and are subdivided into identical spaces each of which is the same size as a playing piece which is placed thereon. Three of the main fields have three spaces each. Six of the main fields have four spaces each. Four of the main fields have five spaces each. Four of the main fields have six spaces each. One of the main fields has seven spaces. One of the main fields has eight spaces. One of the main fields has nine spaces. One of the main fields is marked with an "X" and is called "penalty box". The extra fields are in use when more than two player are playing and are subdivided into identical spaces each of which is the same size as a playing piece which is placed thereon. Two of the extra fields have three spaces each. One of the extra fields has four spaces. In the center of the main fields there is a container for storing the playing pieces.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of two individuals playing a board game which includes eighty one playing pieces, a game board which is marked with a plurality of main fields and a plurality of extra fields, view blockers and which has been constructed in accordance with the principles of the present invention.

FIG. 2 is a plan view of game board with a main field and an extra field of FIG. 1.

FIG. 3 is a perspective view of one the playing pieces which are bar-shaped and made of solid material and are blank on one side with the other side, the face, being painted with one of nine different colors and carries one of nine different digits 1 to 9 of FIG. 1.

DESCRIPTION OF THE PREFERRED EMBODIMENT

In order to best understand the present invention it is necessary to refer to the following description of its preferred embodiment in conjunction with the accompanying drawing. Referring to FIG. 1 a board game 10 includes eighty one playing pieces 11, a game board 12 and six view blocker 13. There are eighty one playing pieces 1 which are bar-shaped, made of solid material and blank on one side. The other side, the face, is painted with one of nine different colors and carries one of nine different digits one to nine. U.S. Pat. No. 4,227,698 teaches a game for children which includes a plurality of like-shaped eighty one playing pieces or tiles. Each piece of a set has a particular design in a particular color on one exposed surface of a piece are unmarked. Each player has a view blocker 13 for concealing his collection of playing pieces 11 from the other players' view.

Referring to FIG. 1 in conjunction with FIG. 2 the game board 12 is marked with a plurality of main fields 14 and a plurality of extra fields 15. The main fields 15 are in use when only two players are playing and are subdivided into identical spaces each of which is the same size as a playing piece 11 which is placed thereon. Three of the main fields 14 have three spaces each. Six of the main fields 14 have four spaces each. Four of the main fields 14 have five spaces each. Four of the main fields 14 have six spaces each. One of the main fields 14 has seven spaces. One of the main fields 14 has eight spaces. One of the main fields 14 has nine spaces. One of the main fields 14 is marked with an "X" and is called "penalty box". The extra fields 15 are in use when more than two player are playing and are subdivided into identical spaces each of which is the same size as a playing piece which is placed thereon. Two of the extra fields 15 have three spaces each. One of the extra fields 15 has four spaces. In the center of the main fields 14 there is a container 16 for storing the playing pieces 11.

U.S. Pat. No. 4,390,183 teaches a game which game includes a game board which has fields for placement of playing pieces in groups. U.S. Pat. No. 3,850,434 teaches a primary game for two individuals. The primary game is laced with luck, challenging the acquisition fervor, competitive spirit and trading shrewdness of the players. The use of a plurality of game boards extends the primary game.

In preparing to play one of the player fills the container 16 with the eighty one playing pieces 11 and properly shake the filled container 16 before each game and places the container 16 in the hole at the center of the game board 12. Each player receives a view blocker 13. The players decide who is to play first, but play passes to the left. Each player draws six playing pieces 11 one at time in turn and places them behind his view blockers 13.

The object of the game is for each player to get rid of all of his playing pieces. When one of the players manages to do so, the game is over. A match is a series of three games. The player with the highest total points after the match ends is the winner. The players designate one player to keep score of each game of the match.

Players must place all of the playing pieces 11 in their possession on the fields according to the rules. A collection of either three or four playing pieces 11 of different colors and the same matching numbers is called, a "simple-set"; a collection of three or more playing pieces 11 of the same color in consecutive numerical order is called, a "straight-set." The number of playing pieces 11 that can be placed on any field must be equal to the number of spaces on this field. The player can only place "simple sets" and "straight sets" on the fields.

When a player has at least one set, either a "simple set" or a "straight set," and he is willing to get into the game, he must declare: "I am placing a set (or sets) to get into the game." The player must also declare the number of playing pieces 11 in his set. The player then places the set (or sets) face-up in front of him and starts to add the playing pieces of the set (or sets) to the field (or fields). For each playing piece which the player adds to the fields he scores ten points. If a player does not have a set with which to get into the game, he must draw an extra playing piece 11 from the container 16 and tries again to get into the game in the next round as play proceeds. If the player decides not to get in the game, the player must draw an extra playing piece 11 and it is the next player's turn to play.

Once in the game, when the player has added at least one set on a proper field, he must declare before each move the number of extra playing pieces 11 which he intends to get rid of and place these playing pieces 11 face-up. He starts to add them to the sets o the fields by moving the newly formed sets to proper fields. Once in the game, a player may decide not to get rid of more playing pieces 11, the player must draw an extra playing piece 11 and the next player, plays. Once in the game, a player can change the existing sets, part or all of them, together with the extra playing piece 11 which the player intends to get rid of, as long as the player ends-up placing all of these playing pieces 11 properly on the fields.

A player can get in the game and get rid of extra playing pieces 11 at the same time but must declare: "I have a set to get into the game and extra playing pieces 11 to get rid of." The player must specify the exact number of these playing pieces 11 and place all of the playing pieces 11 face-up and starts to add them. If a player can not add a playing pieces 11 to any field, he must place it on the "penalty box" which can accommodate any number of playing pieces 11. The rest of the playing pieces 11 including playing pieces 11 which the player intends to get rid of, remain on the proper fields. If a player must place a playing pieces 11 on the "penalty box", the player does not score any points, not even for any playing pieces 11 which he has properly added and each opponent scores: "Twenty Points" for each playing piece 11 which the player has placed on the "penalty box". If a player fails to get in the game, he must place all of his declared playing pieces 11 on the "penalty box" and try to get in the game in the next round.

Once in the game, a player can use playing pieces 11 which he intends to get rid of, together with playing pieces 11 from the "penalty box" to make a play. However, he must declare how many playing pieces 11 from the penalty box which he intends to use in making the play.

Once in the game, a player can use playing pieces 11 only from the "penalty box" to make a play. However, he must declare how many playing pieces 11 from the penalty box which he intends to use in making the play.

A player can get in the game, get rid of extra playing pieces 11 and use playing pieces 11 from the "penalty box" to make a play. However, he must declare how many playing pieces 11 from the penalty box which he intends to use in making the play.

For each playing piece 11 which he has properly added from the "penalty box" the player scores: "ten points". The player can not use playing pieces 11 from the "penalty box" to form a set to get into the game. Once in the game, a player must announce his intention of ending the game. However, he can not make this announcement in the first two rounds. The player declares: "I am ending the game". The player places all his playing pieces 11 face-up and starts to add them. A player can get into the game and end the game at the same time but not in the first two rounds. The player declares: "I have a set to get into the game and I am ending the game". The player places all his playing pieces 11 face-up and starts to add them. The player ending the game gets an extra "ten points" for each playing piece 11 his opponents possess. A player can end the game and use playing pieces 11 from the penalty box while making the same play so long as the play is not in the first two rounds. If a player fails to end the game, the player is out of this game and he loses all the points which he has scored in this game. However, all the playing pieces 11 which were on the boards and the player's playing pieces 11 remain on the proper fields. If a player is forced out of a game, he can come back to the next game of the match. If there are no playing pieces 11 left in the container 16, the game continues including player who are not in the game yet, as they may have an opportunity to get into the game when a proper field becomes vacant, until one of the player ends the game. The player ending the game, starts the next one.

From the foregoing it can be seen that a board game has been described. The players can play this board game on electronic devices such as a computer and mechanical devices as described above. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A board game comprising a main game board, an extra board for use when more than two players are playing, playing pieces and view blocking means for blocking each player's view of each other players' collection of playing pieces, said playing pieces comprising a group of eighty one playing pieces each having numerical indicia and color indicia thereon, each playing piece having a different combination of numerical indicia and color indicia, said main game board comprising a plurality of first fields being divided into a plurality of spaces that are sized and shaped similar to the playing pieces so as to receive the playing pieces thereon during play of the game, said first fields being separate from one another and comprising three first fields each having three spaces, six first fields each having four spaces, four first fields each having five spaces, four first fields each having six spaces, one first field having seven spaces, one first field having eight spaces, one first field having nine spaces and one field being a specially designated field, said main game board also comprising a centrally located recess for storing said playing pieces; said extra board comprising a plurality of second fields, most of said second fields being divided into a plurality of spaces that are sized and shaped similar to the playing pieces so as to receive the playing pieces thereon during play of the game, said second fields being separate from one another and comprising two second fields each having three spaces and one second field having four spaces.

* * * * *